United States Patent [19]

Gagnon et al.

[11] 4,250,863

[45] Feb. 17, 1981

[54] CEMENT BLOCK SPLITTER

[76] Inventors: Pierre Gagnon, 5637 Wilderton Ave., Montreal, Quebec, Canada, H3T 1S1; Pierre Laforest, 1945 De Bruxelles St., Montreal, Quebec, Canada, H1L 5Z5

[21] Appl. No.: 97,566

[22] Filed: Nov. 26, 1979

[51] Int. Cl.[3] ..... B28D 1/32

[52] U.S. Cl. ..... 125/23 C; 83/153; 83/213

[58] Field of Search ..... 125/23 R, 23 C; 83/213, 83/153

[56] References Cited

U.S. PATENT DOCUMENTS

| | | | |
|---|---|---|---|
| 2,593,606 | 4/1952 | Price | 125/23 C |
| 2,881,753 | 4/1959 | Entz | 125/23 R |
| 2,925,080 | 2/1960 | Smith | 125/23 R |
| 3,392,719 | 7/1968 | Clanton | 125/23 R |

*Primary Examiner*—Harold D. Whitehead

[57] ABSTRACT

A cement block splitter is disclosed. The cement block splitter comprises a splitter frame adapted to be mounted perpendicularly over a conveyor belt carrying several consecutive rows of cement blocks, two tables mounted on the splitter frame, one on each side of the conveyor belt at the same level as the conveyor belt, a pair of cutter supports mounted at each end of the splitter frame and each supporting a fixed lower cutter blade located at the level of each cable and an upper blade pivotally mounted on the splitter frame and located above the lower cutter blade, a first carriage frame mounted for reciprocating movement on the splitter frame and adapted to sequentially move the cement blocks of each row between one pair of cutter blades in one direction of movement and between the other pair of cutter blades in the opposite direction of movement of the first carriage frame, and a second carriage frame slidably mounted on the first carriage frame for moving the cement blocks off the conveyor belt onto respective tables in both directions of movement of the first carriage frame.

4 Claims, 6 Drawing Figures

CEMENT BLOCK SPLITTER

This invention relates to a cement block splitter.

In the building construction, it is often desired to use cement blocks having a rough appearance on the outside face of a wall. These blocks are normally made by splitting a wide block into two parts by means of a cutter blade.

It is the object of the present invention to provide a block splitter which can rapidly take a row of blocks advancing on a conveyor belt, split the blocks one by one, replace the split blocks on the conveyor belt and then proceed with the splitting of the next row of blocks.

The block splitter, in accordance with the invention, comprises a splitter frame adapted to be mounted perpendicularly over a conveyor belt carrying several consecutive rows of cement blocks, two tables mounted on the frame, one on each side of the conveyor belt at the same level as the conveyor belt, a pair of cutter supports mounted at each end of the splitter frame and each supporting a fixed lower cutter blade located at the level of each table and an upper cutter blade pivotally mounted on the splitter frame and located above the lower cutter blade, a first carriage frame mounted for reciprocating movement on the splitter frame and adapted to sequentially move the cement blocks of each row between one pair of cutter blades in one direction of movement and between the other pair of cutter blades in the opposite direction of movement of the first carriage frame, and a second carriage frame slidably mounted on the first carriage frame for moving the cement blocks off the conveyor belt onto respective tables in both directions of movement of the first carriage frame.

The lower cutter support is secured to the splitter frame and the lower and upper cutter supports are preferably operated by hydraulic cylinders for moving the upper cutter blade towards the lower cutter blade to split the blocks.

The first carriage frame has a downwardly extending arm contacting the cement blocks and a hydraulic cylinder is preferably connected between the splitter frame and the first carriage frame for alternatively moving the first carriage frame towards one end of the splitter frame and then back towards the other end of the splitter frame.

A downwardly extending arm is also secured to the second carriage frame for engaging the blocks and the first and second carriage frames are preferably interconnected by a hydraulic cylinder for alternatively moving the cement blocks off one side and then the other side of the conveyor blet.

The invention will now be disclosed, by way of example, with reference to the accompanying drawings, in which.

Figures 1, 9:
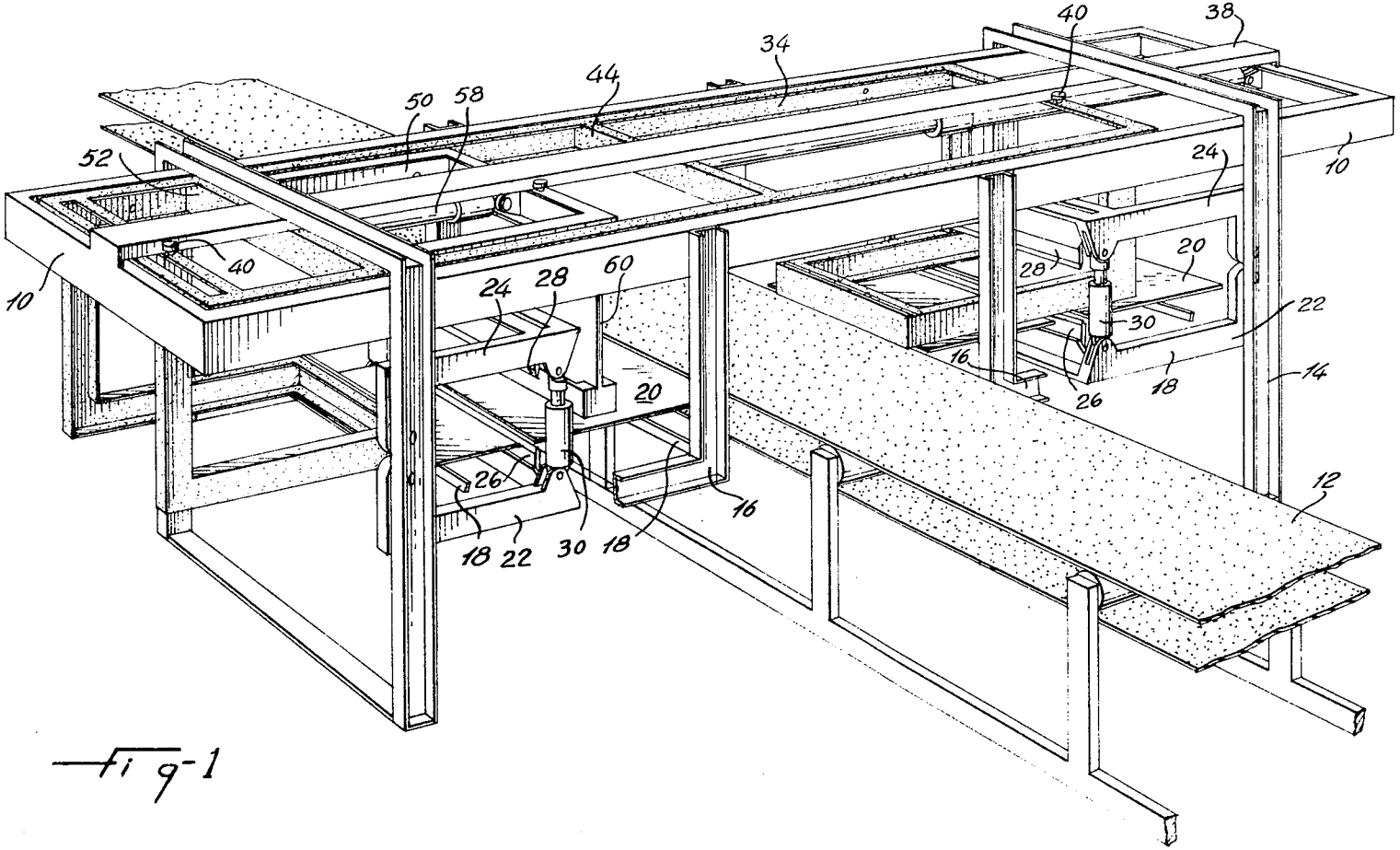
FIG. 1 illustrates a perspective view of the cement block splitter in accordance with the invention.

Referring to FIGS. 1 to 4 of the drawings, there is shown a splitter frame including a rectangular frame 10 supported above a conveyor belt 12 by means of legs 14. A pair of brackets 16 is secured to frame 10 and legs 14 at each end of the splitter frame, and suitable transverse members 18 are provided between each pair of brackets 16 for supporting a table 20, which is located at the same level as the conveyor belt.

A pair of cutter supports is mounted at each end of the splitter frame. The lower support 22 is secured to brackets 16 and supports a cutter blade 26. The upper cutter support is pivotally mounted on the legs 14 and supports a cutter blade 28. The upper and lower cutter supports are interconnected by hydraulic cylinders 30. The cutter blades 26 and 28 are adjustable by means of special bolts 32.

A first carriage frame 34, of generally rectangular form, is mounted for reciprocating movement between the ends of splitter frame 10. As illustrated more clearly in FIG. 4, frame 34 is mounted on wheels 36 which travel on the inside of the flanges of the splitter frame 10. The first carriage frame 34 is also guided longitudinally along a beam 38 secured to splitter frame 10 by means of roller bearings 40. The first carriage frame 34 is operated by a hydraulic cylinder 42 having its cylinder connected to the splitter frame and its piston rod connected to a transverse member 44 of carriage frame 34. Carriage frame 34 is provided with a downwardly extending arm 46, of L-shape configuration, at one end and with a downwardly extending arm 48, of inverted L-shape configuration at its other end. The hydraulic cylinder is operated in both directions for alternatively moving the cement blocks of each row in between alternate pairs of cutter blades 26 and 28.

A second carriage frame 50 is mounted for movement within the first carriage frame 34. The carriage frame 50 moves between transverse members 52 and 44 of the first carriage frame 34. The carriage frame 50 is mounted on wheels 54 which ride on the inside of the flanges of the first carriage frame 34. The carriage frame 50 is also guided along beam 38 of the splitter frame by means of roller bearings 56. The second carriage frame is operated by a hydraulic cylinder 58, having its cylinder connected to transverse member 52 of the first carriage frame 34 and its piston connected to the second carriage frame 50. An arm 60, in the shape of a plate, extends downwardly from carriage frame 50 to a short distance above tables 20 and conveyor belt 12 and so engages the cement blocks during movement of the first and second carriage frames.

Figure 2:
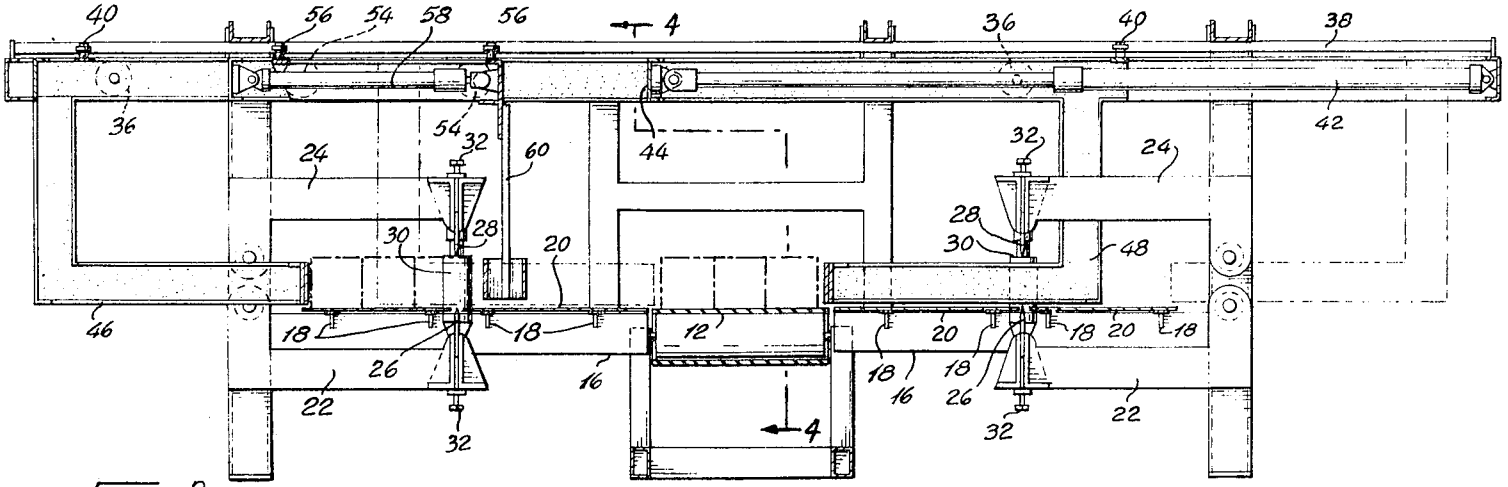
FIG. 2 illustrates a view taken along line 2—2 of FIG. 3.
Figure 3:
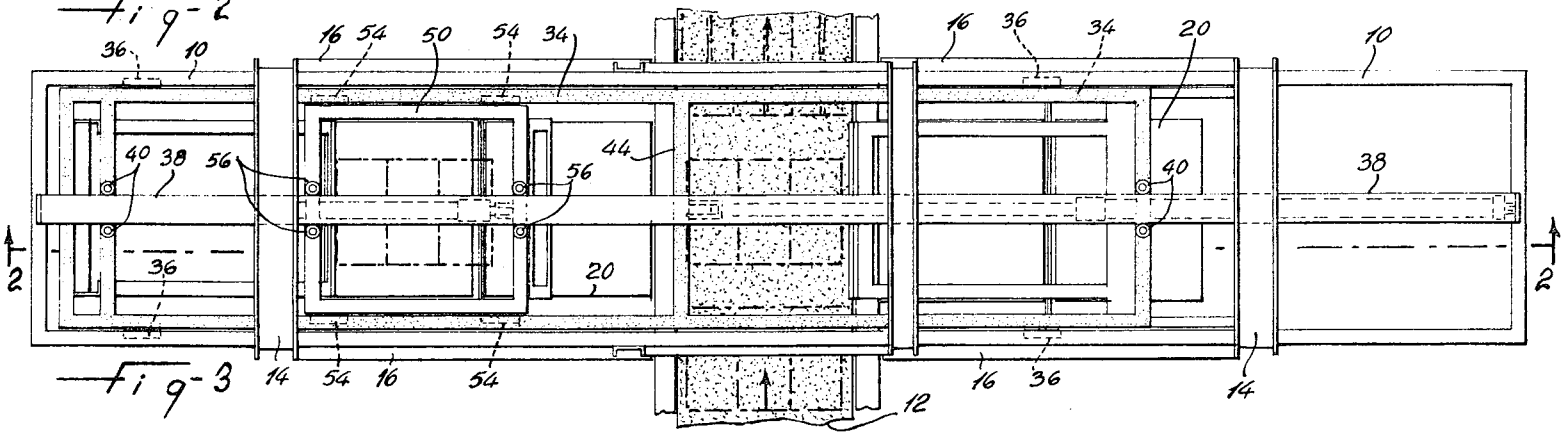
FIG. 3 illustrates a top view of the cement block splitter in accordance with the invention.

The above-disclosed splitter operates as follows:

The conveyor belt is operated intermittently to move consecutive rows of blocks within the splitter frame, as shown in FIG. 3 of the drawings. Let us assume that the first row of blocks was moved to the left, as shown in FIGS. 2 and 3 of the drawings, by the operation of cylinder 42 to extend its piston and by the operation of cylinder 58 to cause the arm 60 to push the blocks against the end of arm 46. Piston 42 is then operated step by step to move each of the blocks at the proper position under the cutter blade 28. The operation of the hydraulic cylinder 42 may be controlled by means of limit switches located in a conventional hydraulic control circuit and it is not believed to be necessary to disclose the hydraulic circuit in detail. When each block is at its proper position under the cutter blade, hydraulic cylinders 30 are operated by the hydraulic control circuit to split the block. When all the blocks of the first row are split, hydraulic cylinder 42 continues its movement to the right to replace the split blocks back onto the conveyor belt. At the same time, cylinder 58 is operated by the hydraulic control circuit to cause arm 60 to push a new row of blocks off the conveyor belt and againthe following row of blocks off the conveyor belt onto the table located on the left-hand side of the conveyor belt and against arm 46 in the position shown in FIG. 2. The cycle then starts over again.

Figure 5:
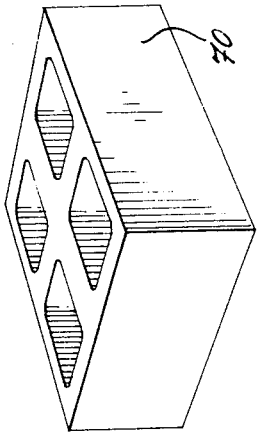
FIGS. 5 and 6 illustrate how a cement block is split in two parts to produce a block having a rough appearance on one face thereof.
Figure 6:
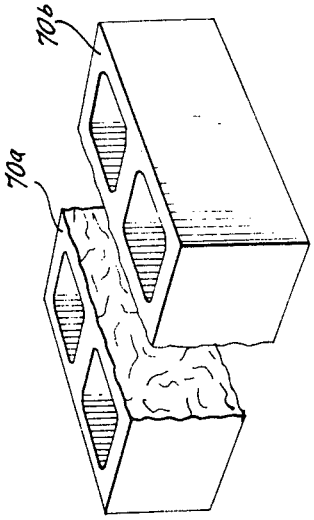
Figure 4:
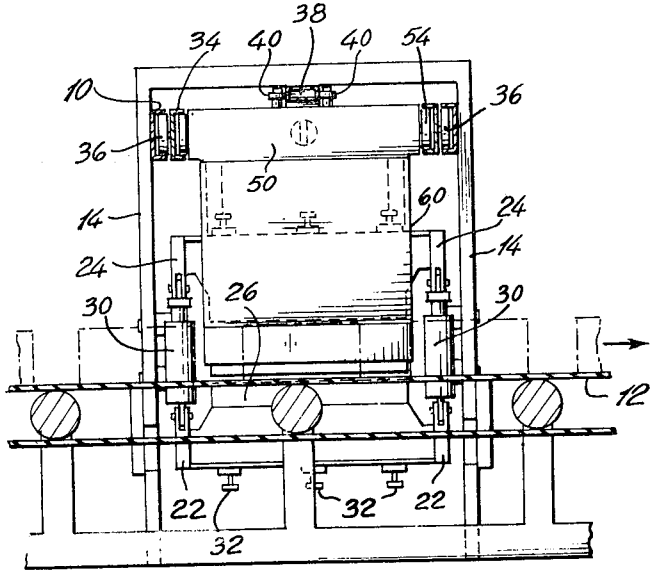
FIG. 4 illustrates a view taken along line 4—4 of FIG. 2.

FIGS. 5 and 6 show in large view a cement block 70 split in two portions 70*a* and 70*b* by the splitter in accordance with the invention.

Although the invention has been disclosed with reference to a preferred embodiment, it is to be understood that it is not limited to such embodiment, and that other alternatives are envisaged within the scope of the following claims.

What I claim is:

1. A cement block splitter comprising:

(a) a splitter frame adapted to be mounted perpendicularly over a conveyor belt carrying several consecutive rows of cement blocks;

(b) two tables mounted on said frame, one on each side of said conveyor belt at the same level as the conveyor belt;

(c) a pair of cutter supports mounted at each end of said splitter frame and each supporting a fixed lower cutter blade located at the level of each table and an upper cutter blade pivotally mounted on the splitter frame and located above said lower cutter blade;

(d) a first carriage frame mounted for reciprocating movement on said splitter frame and adapted to sequentially move the cement blocks of each row between one pair of cutter blades in one direction of movement and between the other pair of cutter blades in the opposite direction of movement of the first carriage frame; and (e) a second carriage frame slidably mounted on said first carriage frame for moving said cement blocks off the conveyor belt onto respective tables in both directions of movement of the first carriage frame.

2. A cement block splitter as defined in claim 1, wherein the lower cutter support is secured to said splitter frame, and wherein the lower and upper cutter supports are interconnected by hydraulic cylinders for moving the upper cutter blade towards the lower cutter blade to split the blocks.

3. A cement block splitter as defined in claim 1, wherein the first carriage frame has a downwardly extending arm engaging said cement blocks and further comprising a hydraulic cylinder interconnecting said splitter frame and the first carriage frame for alternatively moving the first carriage frame towards one end of the splitter frame.

4. A cement block splitter as defined in claim 1, 2 or 3, wherein a downwardly extending arm is secured to said second carriage frame for engaging the blocks and wherein the first and the second carriage frames are interconnected by a hydraulic cylinder for alternatively moving the blocks off one side and then the other side of the conveyor belt.

* * * * *